US011499471B2

(12) United States Patent
Zhang et al.

(10) Patent No.: US 11,499,471 B2
(45) Date of Patent: Nov. 15, 2022

(54) METHOD AND SYSTEMS FOR REDUCING HEAT LOSS TO A TURBOCHARGER DURING COLD ENGINE STARTING

(71) Applicant: Ford Global Technologies, LLC, Dearborn, MI (US)

(72) Inventors: Xiaogang Zhang, Novi, MI (US); Peter Moilanen, Ann Arbor, MI (US); Ray Host, Mount Clemens, MI (US); Steven Wooldridge, Manchester, MI (US); William Charles Ruona, Farmington Hills, MI (US); Jianwen Yi, West Bloomfiled, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 55 days.

(21) Appl. No.: 17/156,886

(22) Filed: Jan. 25, 2021

(65) Prior Publication Data

US 2022/0235694 A1 Jul. 28, 2022

(51) Int. Cl.
*F02B 37/18* (2006.01)
*F02B 37/02* (2006.01)

(52) U.S. Cl.
CPC ..... *F02B 37/186* (2013.01); *F02B 37/02* (2013.01); *F01N 2340/06* (2013.01)

(58) Field of Classification Search
CPC ..... F02B 37/186; F02B 37/02; F01N 2340/06
See application file for complete search history.

(56) References Cited

U.S. PATENT DOCUMENTS

| | | | | |
|---|---|---|---|---|
| 6,543,228 | B2 | 4/2003 | Deacon | |
| 7,621,128 | B2 | 11/2009 | Czarnowski et al. | |
| 8,234,865 | B2 | 8/2012 | Andrews | |
| 8,316,642 | B2 | 11/2012 | McEwan et al. | |
| 8,695,338 | B2 | 4/2014 | Sato et al. | |
| 9,322,327 | B2 | 4/2016 | Lombard et al. | |
| 10,718,260 | B2 * | 7/2020 | Ito | F01N 5/04 |
| 2011/0271673 | A1 | 11/2011 | Koenigsegg | |
| 2020/0173308 | A1 * | 6/2020 | Oki | F02B 39/16 |

FOREIGN PATENT DOCUMENTS

| | | | |
|---|---|---|---|
| EP | 1440222 | b1 | 9/2006 |
| EP | 2385231 | A2 | 11/2011 |
| JP | 2003003836 | A | 1/2003 |
| JP | 6375808 | B2 | 8/2018 |

* cited by examiner

*Primary Examiner* — Audrey B. Walter
*Assistant Examiner* — Edward Bushard
(74) *Attorney, Agent, or Firm* — Vincent Mastrogiacomo; McCoy Russell LLP

(57) ABSTRACT

Systems and methods for reducing heat loss to a turbocharger during cold engine starting are described. In one example, a turbocharger bypass pipe and a turbocharger turbine pipe are oriented at forty five degrees relative to a longitudinal axis of a catalyst so that a turbocharger turbine may be completely bypassed, thereby increasing the amount of energy that may be transferred to the catalyst.

13 Claims, 7 Drawing Sheets

METHOD AND SYSTEMS FOR REDUCING HEAT LOSS TO A TURBOCHARGER DURING COLD ENGINE STARTING

FIELD

The present description relates to a method and systems for reducing heat loss to a turbocharger during cold engine starting. The method and systems may improve delivery of heat to a catalyst during an engine cold start.

BACKGROUND AND SUMMARY

An internal combustion engine of a vehicle may emit higher levels of emissions during cold engine starting. A catalyst that is coupled to the engine may not be prepared to process the engine emissions for a period of time after the engine is started. Therefore, higher levels of engine emissions may reach the atmosphere than may be desired.

One way to reduce engine emissions is to raise a temperature of the catalyst to above catalyst light-off temperature (e.g., a temperature at which the catalyst may operate above a threshold efficiency level) sooner. However, many engines include a turbocharger to increase engine output power and reduce engine fuel consumption. The turbochargers include a turbine that may be positioned in the engine's exhaust system upstream of the catalyst. The turbine may operate as a heat sink when an engine is started so that a temperature of exhaust gases that enter the catalyst may be reduced until the turbine and turbocharger reach higher temperatures. As a result, the catalyst may not reach its light-off temperature as soon as may be desired. Consequently, engine emissions may pass by the catalyst without being treated.

The inventors herein have recognized the above-mentioned issues and have developed an engine system, comprising: a catalyst including a plurality of flow chambers; a turbine pipe outlet arranged at about 45 degrees relative to a centerline of the catalyst; a turbine bypass passage pipe outlet arranged at about 45 degrees relative to the centerline of the catalyst; a three-way valve configured to distribute exhaust gas to the turbine bypass passage pipe outlet and the turbine pipe outlet; and an actuator to adjust a position of the three-way valve.

By orienting a turbine pipe and a turbine bypass passage pipe at about 45 degrees from a centerline of a catalyst, it may be possible to provide the technical result of reducing heat lost to a turbocharger turbine so that a catalyst may reach its light-off temperature sooner, thereby reducing engine emissions levels. In particular, the 45 degree angle may facilitate use of a three-way valve to control exhaust flow through the turbine bypass passage pipe and the turbine pipe so that heat loss to the turbocharger turbine may be significantly reduced. In addition, the angular arrangement between the turbine bypass passage pipe and the centerline of the catalyst and the angular arrangement between the turbine pipe and the centerline of the catalyst may improve catalyst brick utilization during an engine cold start so that engine emissions may be reduced.

The present description may provide several advantages. In particular, the approach may reduce engine tailpipe emissions. Further, the approach may reduce system cost via utilization of a single turbine bypass actuator. In addition, the approach may reduce flow passage length so that more exhaust gas heat may be conserved until the exhaust gases reach the catalyst, thereby reducing an amount of time to reach catalyst light-off temperature.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where:

FIGS. 1-12 are drawn approximately to scale, however, other relative dimensions may be used, in other embodiments.

DETAILED DESCRIPTION

Figure 1:
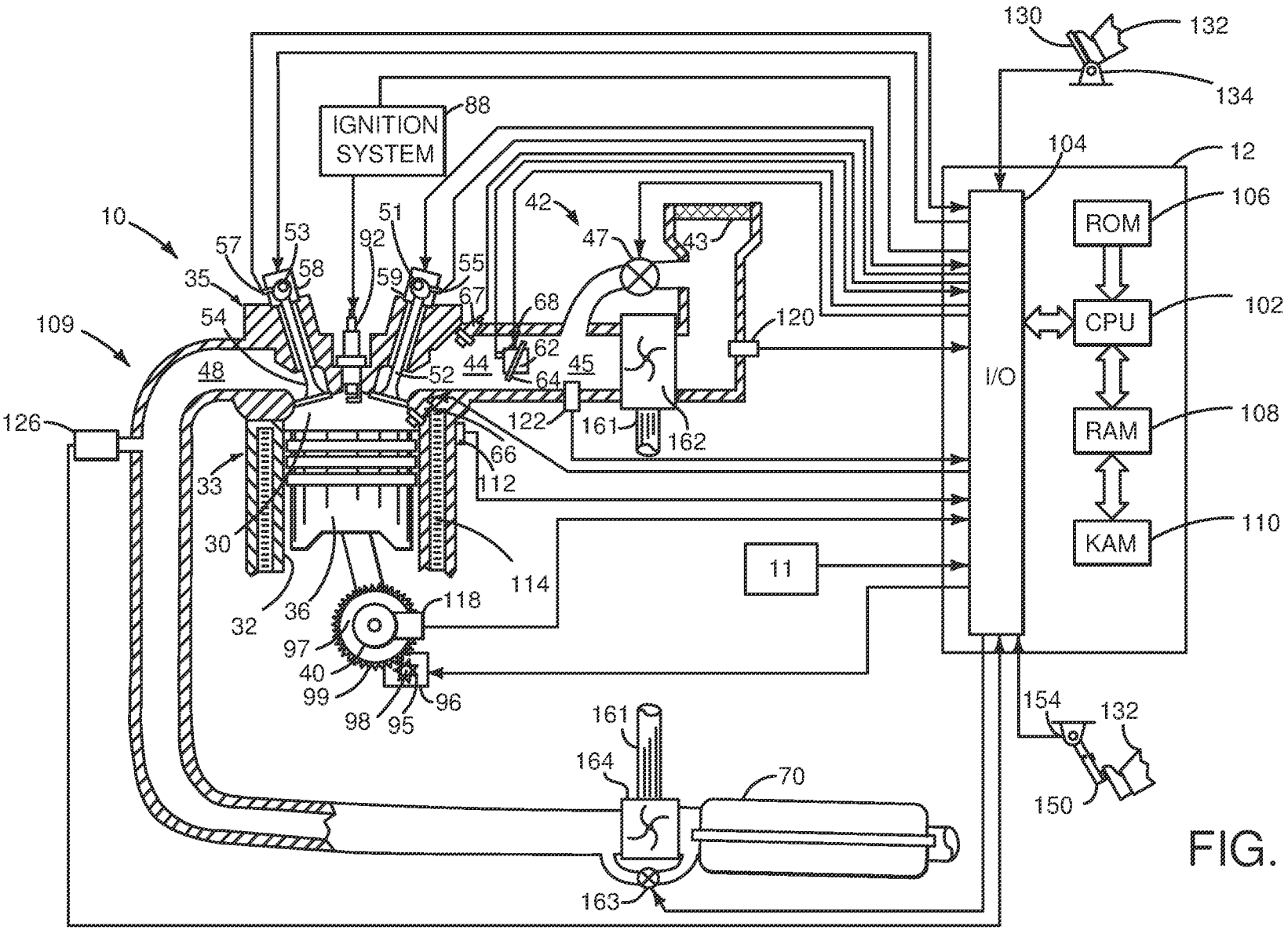
FIG. 1 is a schematic diagram of an engine.

The present description is related to reducing exhaust heat that may be lost heating a turbocharger turbine during an engine cold start. The exhaust heat may be conserved via a turbocharger bypass pipe and turbocharger turbine pipe that are strategically arranged such that both the turbocharger bypass pipe and turbocharger turbine pipe may direct exhaust gas at substantially an entire face of a catalyst. The exhaust system may be part of a turbocharged engine as shown in FIG. 1. Example exhaust systems and exhaust system components are shown in FIGS. 2-12. An example method for operating an exhaust system is shown in FIG. 13.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2. The controller employs the actuators shown in FIGS. 1-12 to adjust engine and driveline or powertrain operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Optional starter 96 may be directly mounted to the front of the engine or the rear of the engine. In some examples, starter 96 may selectively supply power to crankshaft 40 via a belt or chain. In addition, starter 96 is in a base state when not engaged to the engine crankshaft 40 and flywheel ring gear 99.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electromechanical devices.

Direct fuel injector 66 is shown positioned to inject fuel directly into cylinder 30, which is known to those skilled in the art as direct injection. Port fuel injector 67 is shown positioned to inject fuel into the intake port of cylinder 30, which is known to those skilled in the art as port injection. Fuel injectors 66 and 67 deliver liquid fuel in proportion to pulse widths provided by controller 12. Fuel is delivered to fuel injectors 66 and 67 by a fuel system (not shown) including a fuel tank, fuel pump, and fuel rail (not shown).

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Ignition system 88 provides an ignition spark to combustion chamber 30 via spark plug 92 in response to controller 12. Exhaust system 109 may include a universal Exhaust Gas Oxygen (UEGO) sensor 126, which is shown coupled to exhaust manifold 48 upstream of three-way catalyst 70. Alternatively, a two-state exhaust gas oxygen sensor may be substituted for UEGO sensor 126.

Catalyst 70 may include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a propulsive effort pedal 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start or stop the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
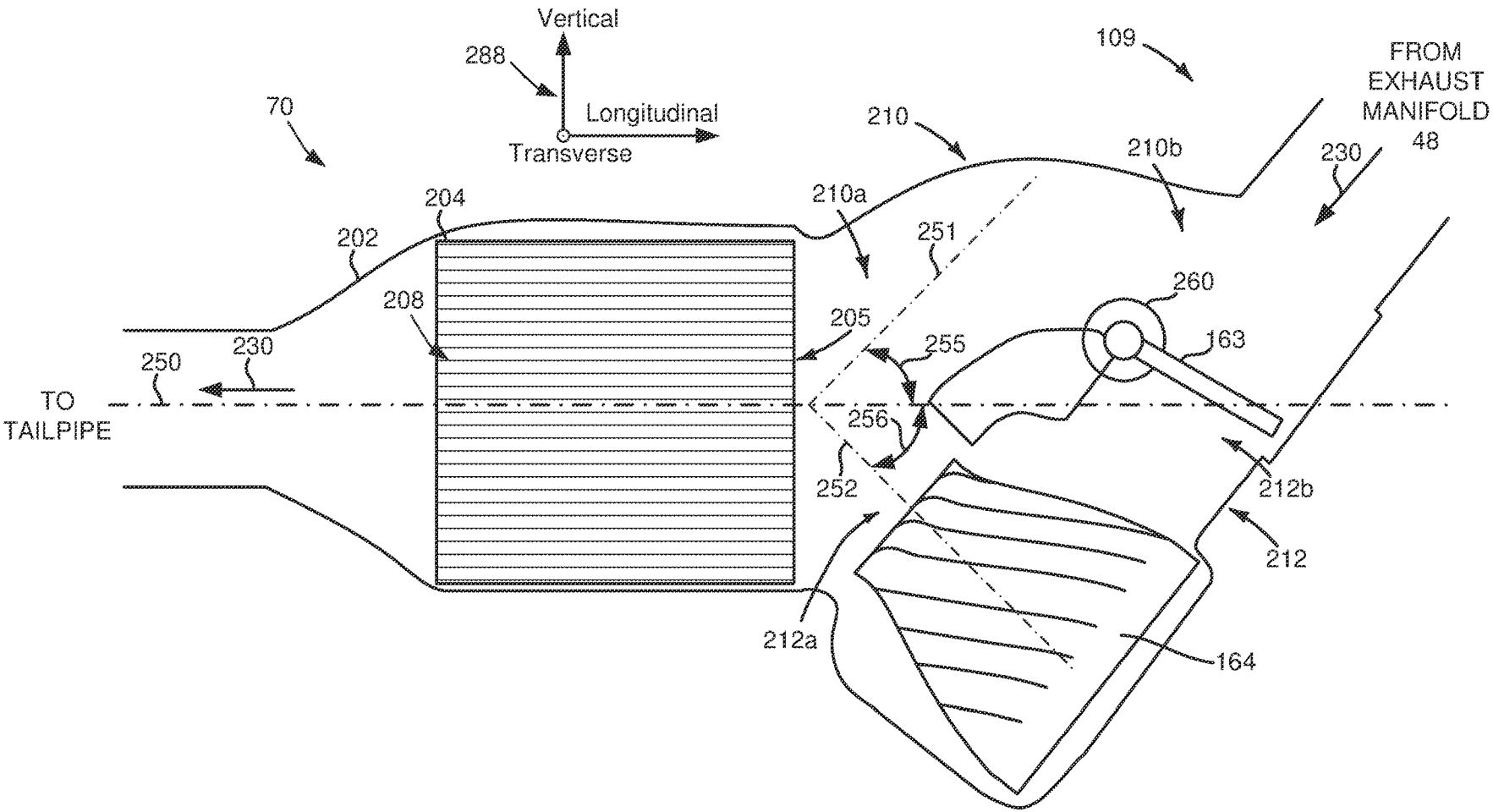
FIGS. 2-4 are schematic views of a first example exhaust system that includes a turbine bypass pipe, turbine pipe, and catalyst.

FIG. 2 is a detailed cut-away section of a first example of exhaust system 109 shown in FIG. 1. Longitudinal, vertical, and transverse directions are as indicated at 288. Exhaust gas flows from the engine exhaust manifold 48 shown in FIG. 1 and it may flow into either or both of turbocharger turbine bypass pipe 210 and turbocharger turbine pipe 212. The exhaust gases flow through cells 208 in catalyst substrate 204 before flowing out of a tailpipe (not shown). In particular, the exhaust flows through the cells 208 in the longitudinal direction of cells 208. Exhaust flows as indicated by arrows 230.

Line 250 indicates a centerline of catalyst substrate 204. The centerline 250 runs parallel with the longitudinal direction of cells 208. Cells 208 may support a wash coating (not shown) comprising platinum, palladium, or other metals. Cells 208 direct the exhaust flow through substrate 204. Catalyst housing 202 supports substrate 204.

Turbocharger turbine bypass pipe 210 includes an outlet 210*a* and an inlet 210*b*. A centerline 251 of outlet 210*a* of turbocharger turbine bypass pipe 210 is oriented at about a 45 degree angle 255 (e.g., the angle between the centerline 251 of the turbocharger turbine bypass pipe outlet 210*a* and the center line 250 of the catalyst substrate 204 may be in a range from 35 degrees to 55 degrees) relative to centerline 250 of catalyst substrate 204. By placing outlet 210*a* at a 45 degree angle 255 relative to centerline 250, exhaust gases that flow through outlet 210*a* may be directed across the entire front face 205 of catalyst substrate 204. In addition, the entirety of exhaust gases passing through turbocharger turbine bypass pipe 210 may be directed to front face 205 of catalyst substrate 204. Further, flow utilization may be improved via the angled inlet and exhaust gases flowing through the turbocharger turbine bypass pipe 210 may sweep the entire substrate front face or surface 205.

Turbocharger turbine pipe 212 includes an outlet 212*a* and an inlet 212*b*. A centerline 252 of outlet 212*a* of turbocharger turbine pipe 212 is oriented at about 45 degree angle 256 (e.g., the angle between the centerline 252 of turbocharger turbine pipe outlet 212*a* and the center line 250 of the catalyst substrate 204 may be in a range from 35 degrees to 55 degrees) from centerline 250 of catalyst substrate 204. By placing outlet 212*a* at a 45 degree angle 256 relative to centerline 250, exhaust gases that flow through outlet 212*a* may be directed across the entire front face 205 of catalyst substrate 204. In addition, the entirety of exhaust gases passing through turbocharger turbine pipe 212 may be directed to front face 205 of catalyst substrate 204. Further, flow utilization may be improved via the angled inlet and exhaust gases flowing through the turbocharger turbine pipe 212 may sweep the entire substrate front face or surface 205.

In this example, waste gate 163 is a three way valve that is positioned at and between turbocharger turbine bypass pipe inlet 210*b* and turbocharger turbine pipe inlet 212*b*. In a first position, waste gate 163 may fully close off exhaust flow through turbocharger turbine bypass pipe 210. In a second position, waste gate 163 may fully close off exhaust flow through turbocharger turbine pipe 212. Waste gate 163 may also be adjusted to intermediate positions between the first position and the second position so that exhaust may flow through both the turbocharger turbine pipe 212 and turbocharger turbine bypass pipe 210. Actuator 260 may adjust the position of waste gate 163. Actuator 260 may be pneumatic or electrically operated.

Figure 3:
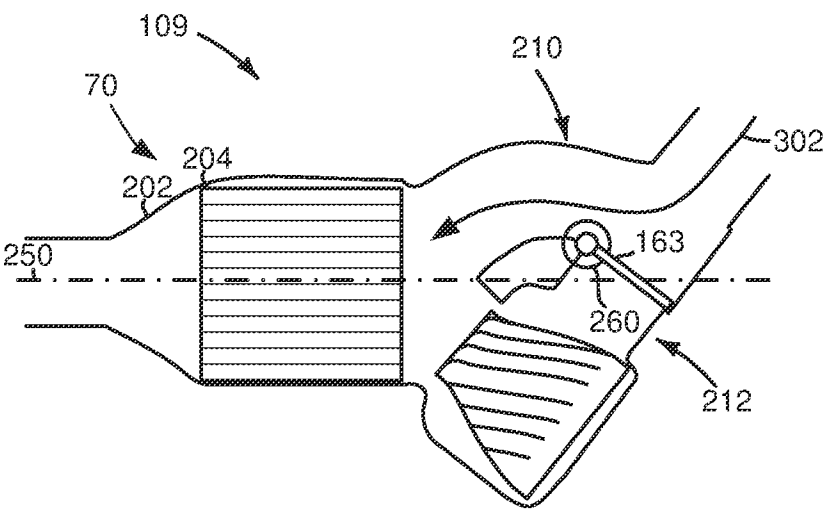

Referring now to FIG. 3, the example exhaust system of FIG. 2 is shown with waste gate 163 in a first position where waste gate 163 fully closes off exhaust flow through turbocharger turbine pipe 212. By positioning waste gate 163 into the first position, substantially all exhaust gas (e.g., greater than 90%) flowing in exhaust system 109 may flow through turbocharger turbine bypass pipe 210. The flow of exhaust gases is indicated by arrow 302. In addition, the exhaust gas flowing through the turbocharger turbine bypass pipe 210 may be directed across the entire face of catalyst substrate 204 to utilize a greater percentage of catalyst 70. Very little heat of the exhaust gases may warm turbine 164 during a cold engine start when waste gate 163 is in the first position.

Figure 4:
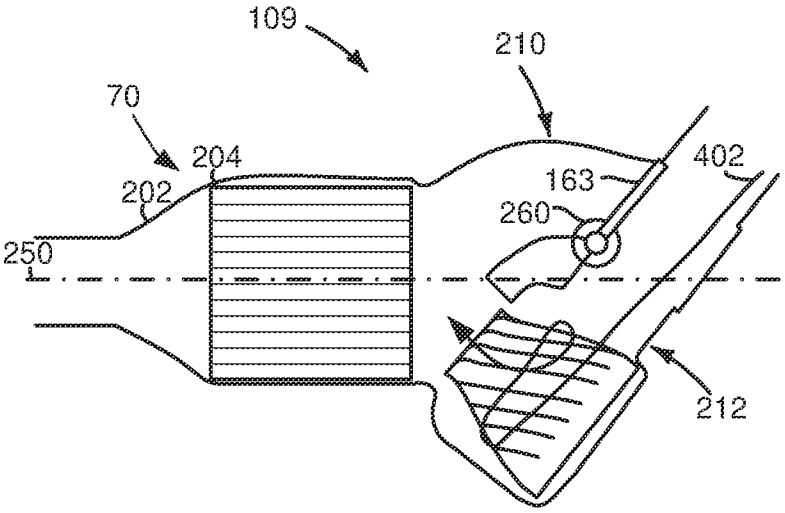

Referring now to FIG. 4, the example exhaust system of FIG. 2 is shown with waste gate 163 in a second position where waste gate 163 fully closes off exhaust flow through turbocharger turbine bypass pipe 210. By positioning waste gate 163 into the second position, substantially all exhaust gas (e.g., greater than 90%) flowing in exhaust system 109 may flow through turbocharger turbine pipe 212. The flow of exhaust gases is indicated by arrow 402. Additionally, the exhaust gas flowing through the turbocharger turbine pipe 212 may be directed across the entire face of catalyst substrate 204 to utilize a greater percentage of catalyst 70.

Figure 5:
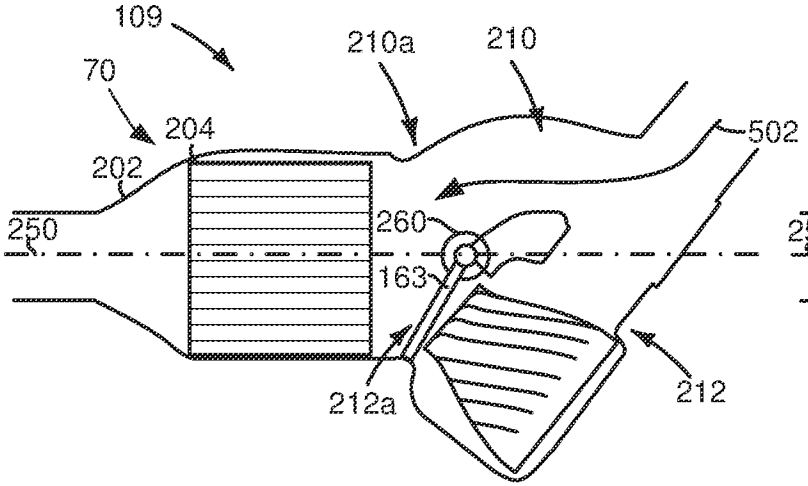

Referring now to FIG. 5, an exhaust system similar to exhaust system 109 in FIG. 2 is shown. However, in this example, waste gate 163 is a three way valve that is positioned at and between turbocharger turbine bypass pipe outlet 210*a* and turbocharger turbine pipe outlet 212*a*. In a first position, waste gate 163 may fully close off exhaust flow through turbocharger turbine pipe 212. In a second position, waste gate 163 may fully close off exhaust flow through turbocharger turbine bypass pipe 210. Waste gate 163 may also be adjusted to intermediate positions between the first position and the second position so that exhaust may flow through both the turbocharger turbine pipe 212 and turbocharger turbine bypass pipe 210. Actuator 260 may adjust the position of waste gate 163. Actuator 260 may be pneumatic or electrically operated.

In FIG. 5, waste gate 163 is shown in a first position where waste gate 163 fully closes off exhaust flow through turbocharger turbine pipe 212 via closing outlet 212*a*. By positioning waste gate 163 into the first position, substantially all exhaust gas (e.g., greater than 90%) flowing in exhaust system 109 may flow through turbocharger turbine bypass pipe 210. The flow of exhaust gases is indicated by arrow 502. In addition, the exhaust gas flowing through the turbocharger turbine bypass pipe 210 may be directed across the entire face of catalyst substrate 204 to utilize a greater percentage of catalyst 70. Very little heat of the exhaust gases may warm turbine 164 during a cold engine start when waste gate 163 is in the first position.

Figure 6:
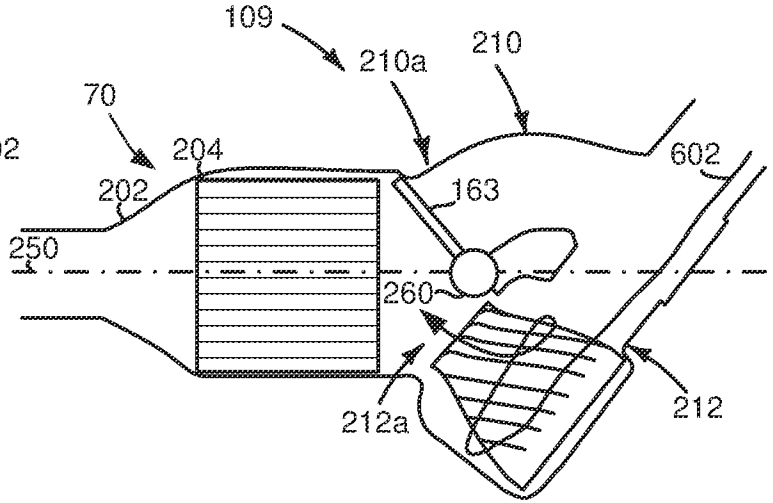
FIGS. 5 and 6 are schematic views of a second example exhaust system that includes a turbine bypass pipe, turbine pipe, and catalyst.

Referring now to FIG. 6, the exhaust system shown in FIG. 5 is shown with waste gate 163 in a second position. The second position is a position where waste gate 163 fully closes off exhaust flow through turbocharger turbine bypass pipe 210. By positioning waste gate 163 into the second position, substantially all exhaust gas (e.g., greater than 90%) flowing in exhaust system 109 may flow through turbocharger turbine pipe 212. The flow of exhaust gases is indicated by arrow 602. Additionally, the exhaust gas flowing through the turbocharger turbine pipe 212 may be directed across the entire face of catalyst substrate 204 to utilize a greater percentage of catalyst 70.

Referring now to FIGS. 7-10, another embodiment of waste gate 163 is shown. In this embodiment, waste gate 163 is for a twin scroll turbocharger. A plan view of waste gate 163 is shown in several positions to illustrate the functionality of waste gate 163.

Figure 7:
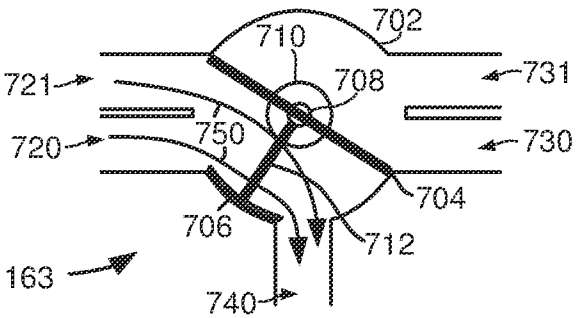

In FIG. 7, waste gate 163 is shown in a position where exhaust gases fully bypass the turbocharger turbine (not shown). Waste gate 163 includes a cylindrical shield 702 or housing in which rectangular plate 704 and curved plate 706 rotate about central rotation axle 708. Central rotation axle 708 is coupled to rectangular plate 704, and rectangular plate 704 is coupled to curved plate 706 via connector 712. Actuator 710 may simultaneously control the position of rectangular plate 704, central rotational axle 708, and curved plate 706 to control a direction of exhaust flow through waste gate 163. In the position shown in FIG. 7, waste gate 163 allows exhaust to flow from inlets 720 and 721 to turbocharger bypass pipe 740, which directs exhaust directly from waste gate 163 to catalyst 70 (not shown). In this position, waste gate 163 prevents exhaust flow to twin scrolls 730 and 731, which directly provide exhaust to the turbocharger turbine (not shown). Exhaust flow to the turbine is prevented by rectangular plate 704 fully covering twin scrolls 730 and 731. Exhaust flows through waste gate 163 in the direction of arrows 750. Curved plate 706 is positioned away from turbocharger bypass pipe 740 to allow exhaust to flow through the waste gate 163.

Figure 8:
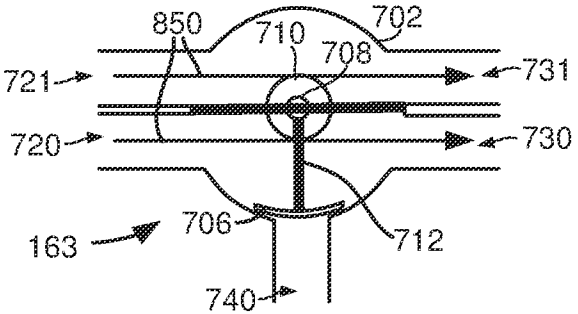
FIGS. 7-12 are schematic views of an example valve for an exhaust system that includes a twin scroll turbocharger.

In FIG. 8, waste gate 163 is shown in a position where exhaust gases flow to the turbocharger turbine (not shown) and do not flow to the turbocharger bypass pipe or passage. In the position shown in FIG. 8, waste gate 163 allows exhaust to flow from inlets 720 and 721 to twin scrolls 730 and 731, which direct exhaust directly from waste gate 163 to the turbocharger turbine (not shown). In this position, waste gate 163 prevents exhaust flow to turbocharger bypass pipe 740, which directly provides exhaust to the catalyst (not shown). Specifically, exhaust flow to the turbocharger bypass pipe 740 is prevented by curved plate 706 fully covering bypass pipe 740. Exhaust flows through waste gate 163 in the direction of arrows 850. Rectangular plate 704 is positioned to allow exhaust to flow from inlets 720 and 721 to twin scrolls 730 and 731.

Figure 10:
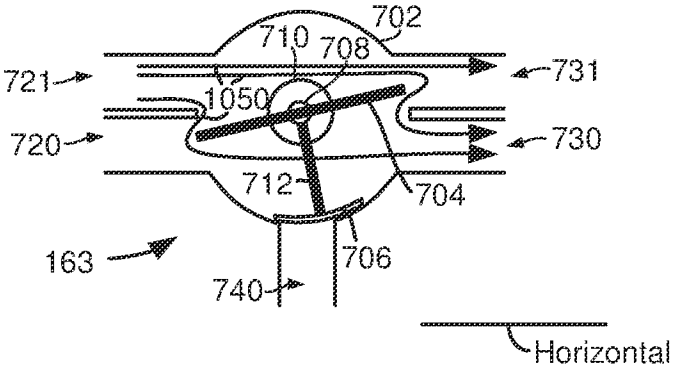
Figure 9:
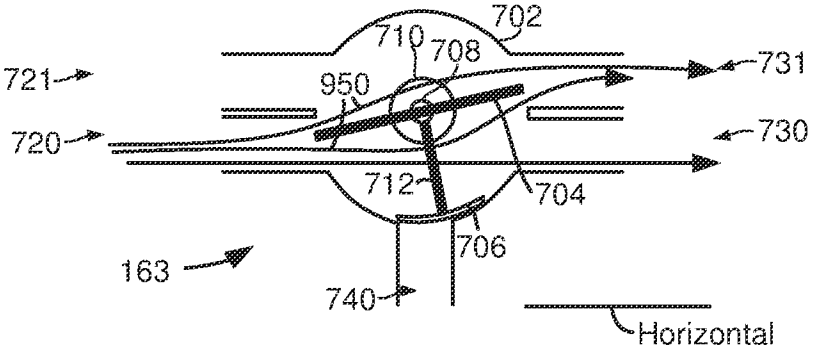

Referring now to FIGS. 9 and 10, waste gate 163 is shown in a position where rectangular plate is 15 degrees from horizontal. Inlet 720 may be coupled to an exhaust manifold of a first group of engine cylinders and inlet 721 may be coupled to an exhaust manifold of a second group of engine cylinders. Curved plate 706 fully covers turbocharger bypass pipe 740 so that exhaust does not flow directly from waste gate 163 to catalyst 70 shown in FIG. 1. Rectangular plate 704 allows exhaust gases to flow from the first group of cylinders to each of twin scrolls 730 and 731 as indicated by arrows 950 in FIG. 9. Rectangular plate 704 allows exhaust gases to flow from the second group of cylinders to each of twin scrolls 730 and 731 as indicated by arrows 1050 in FIG. 10. In this way, exhaust flow from both groups of cylinders may support flow through both scroll passages so that flow to the twin scrolls may not be negatively affected by lack of communication between a scroll and a cylinder group.

Figure 11:
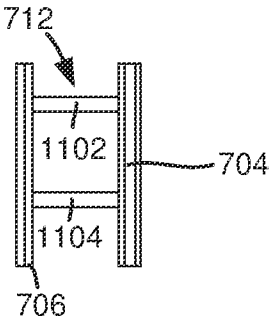

Referring now to FIG. 11, a side view of connector 712 is shown. In this example, connector 712 is comprised of two beams 1102 and 1104. First beam 1102 is biased toward a top side and second beam 1104 is biased toward a bottom side of rectangular plate 704. The two beams 1102 and 1104 support the curved plate 706 while allowing exhaust to flow between rectangular plate 704 and curved plate 706.

Figure 12:
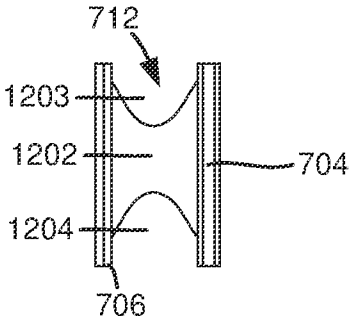
Figure 13:
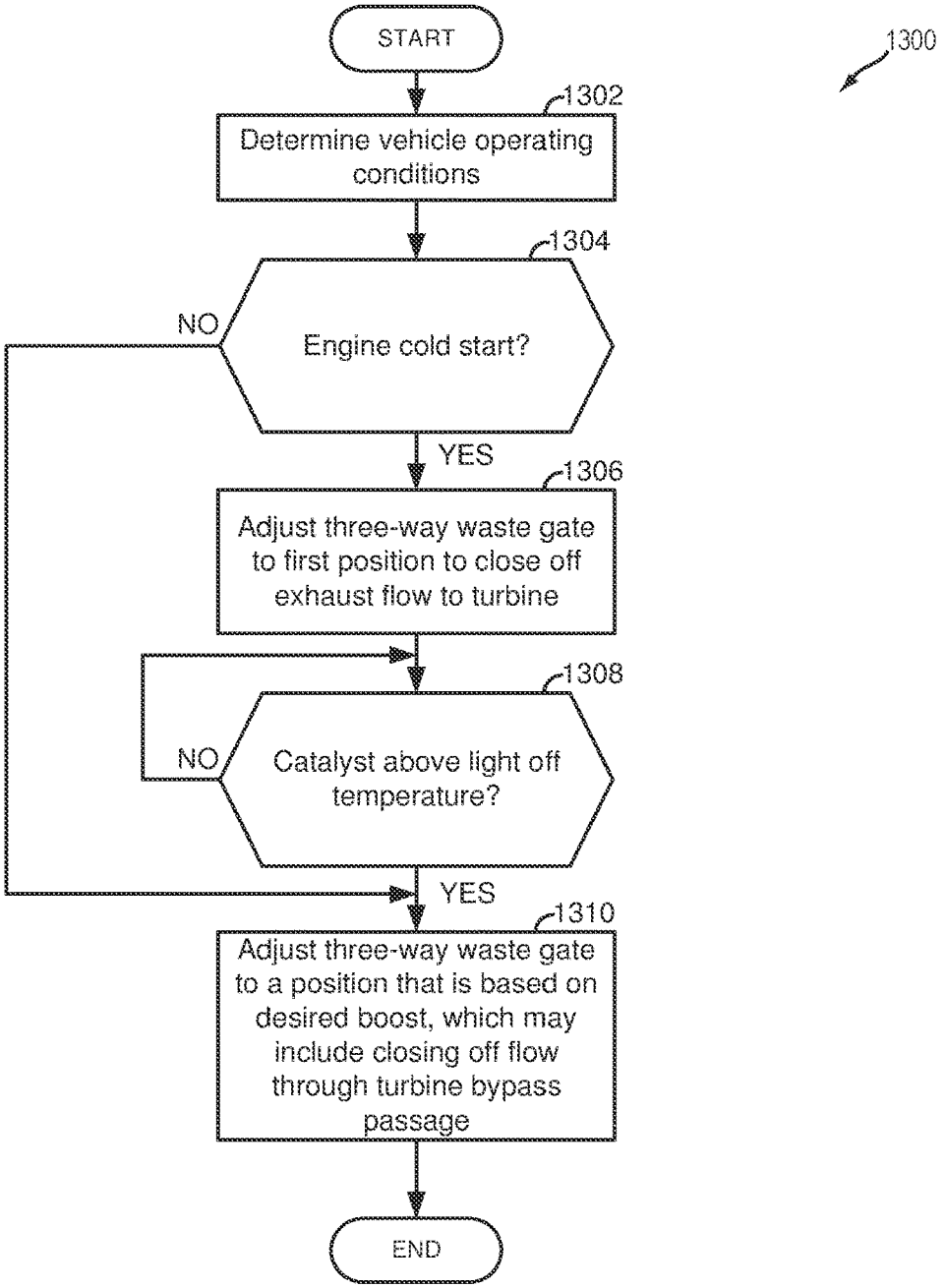
FIG. 13 is a flowchart of a method for operating a valve of an exhaust system.

Referring now to FIG. 12, a side view of connector 712 is shown. In this example, connector 712 is comprised of a single plate 1202. Plate 1202 includes a first trough 1203 and a second trough 1204 that allow exhaust to flow between rectangular plate 704 and curved plate 706. Plate 1202 supports the curved plate 706 while allowing exhaust to flow between rectangular plate 704 and curved plate 706.

The systems of FIGS. 1-12 provide for an engine system, comprising: a catalyst including a plurality of flow chambers; a turbine pipe arranged at about 45 degrees relative to a centerline of the catalyst; a turbine bypass passage pipe arranged at about 45 degrees relative to the centerline of the catalyst; a three-way valve configured to distribute exhaust gas to the turbine bypass passage pipe outlet and the turbine outlet pipe; and an actuator to adjust a position of the three-way valve. The system further comprises a controller including executable instructions stored in non-transitory memory that cause the controller to substantially fully close the inlet to the turbine via the actuator during an engine cold start. The system includes where the three-way valve is positioned at an inlet of the turbine pipe and at an inlet of the turbine bypass passage pipe. The system includes where the three-way valve is positioned between an inlet of the turbine pipe and the inlet of the turbine bypass passage pipe. The system includes where the three-way valve is positioned at an outlet of the turbine bypass passage pipe and at an outlet of the turbine pipe. The system includes where the three-way valve is positioned between the outlet of the turbine pipe and the outlet of the turbine bypass passage pipe. The system includes where the turbine pipe and the turbine bypass passage pipe are coupled to a housing for the catalyst.

The systems of FIGS. 1-12 provide for an engine system, a system for complete exhaust gas bypass using a rotary flow control valve, comprising: a cylindrical shield; a rectangular plate spanning a diameter of the cylindrical shield; a curved plate positioned on a circumference of the cylindrical shield; and a central rotation axle controlling a rotational motion of the rectangular plate and the curved plate; where the rectangular plate is directly attached to the central rotation axle and the curved plate is attached to the central rotation axle via two beams. The system includes where the rectangular plate is directly attached to the central rotation axle. The system includes where the curved plate is attached to the central rotational axle via two beams. The system includes where the curved plate is attached to the central rotational axle via two a plate. The system further comprises an actuator and a controller. The system further comprises a housing for the cylindrical shield, rectangular plate, and curved plate. The system includes where the housing includes five passages.

Referring now to FIG. 13, a flow chart of a method for operating a waste gate is shown. The method of FIG. 13 may be incorporated into and may cooperate with the system of FIG. 1. Further, at least portions of the method of FIG. 13 may be incorporated as executable instructions stored in non-transitory memory while other portions of the method may be performed via a controller transforming operating states of devices and actuators in the physical world.

At 1302, method 1300 determines vehicle operating conditions. In one example, method 1300 determines engine temperature, ambient air temperature, amount of time since a most recent engine start, driver demand torque, engine speed, and engine load from the various sensors described herein. Method 1300 proceeds to 1304 after determining vehicle operating conditions.

At 1304, method 1300 judges if the engine is presently undergoing a cold engine start. A cold engine start may occur when engine temperature is less than a threshold temperature, the engine is being cranked or is at idle, the engine has been running (e.g., combusting fuel) for less than a threshold amount of time. If method 1300 judges that the engine is presently undergoing a cold engine start, the answer is yes and method 1300 proceeds to 1306. Otherwise, the answer is no and method 1300 proceeds to 1310.

At 1306, method 1300 adjusts a waste gate to a first position to fully close off exhaust flow to a turbocharger turbine. In one example, the waste gate may be the waste gate that is shown in FIG. 2. In other examples, the waste gate may be the waste gate shown in FIGS. 5 and 6. In still other examples, the waste gate may be the waste gate shown in FIGS. 7-10. Method 1300 proceeds to 1308.

At 1308, method 1300 judges if the catalyst's temperature is above the catalyst's light-off temperature. If so, the answer is yes and method 1300 proceeds to 1310. Otherwise, the answer is no and method 1300 returns to 1308.

At 1310, method 1300 adjusts a position of the waste gate to a position that is based on a desired boost amount. The desired boost amount may be a function of engine speed and driver demand torque. In one example, the waste gate may be adjusted to a second position at which the waste gate fully closes off exhaust flow to the turbocharger turbine bypass pipe 210. By fully closing off exhaust flow to the turbocharger bypass pipe 210, full boost pressure may be provided to the engine. Alternatively, the waste gate may be adjusted to a third position that allows exhaust to flow through the turbocharger turbine bypass pipe 210 and through the turbocharger turbine pipe 212. The third position may be useful for part load conditions. Method 1300 proceeds to exit.

In this way, it may be possible to reduce heat loss to a turbocharger turbine during cold engine starting conditions. If the engine is warm, the waste gate position may be adjusted to improve engine efficiency. The waste gate may be constructed as a three-way valve as shown herein.

Thus, the method of FIG. 13 provides for a method for operating a turbocharger three-way valve, comprising: adjusting a position of the three-way valve to prevent exhaust gas flow through a turbine during an engine cold start; flowing exhaust gases to a catalyst via a turbine bypass passage pipe that is arranged at about 45 degrees relative to a centerline of the catalyst during the cold start; adjusting the position of the three-way valve to allow exhaust gas flow through the turbine after the engine cold start and to prevent exhaust gas flow through the turbine bypass passage pipe after the cold start, wherein the exhaust gases flow from the turbine through a turbine pipe that is arranged about 45 degrees relative to a centerline of the catalyst. The method further comprises adjusting the position of the three-way valve to permit exhaust gas flow through the turbine and the turbine bypass passage pipe. The method includes where the three-way valve is positioned at an inlet of the turbine bypass passage pipe and at an inlet of a turbine pipe. The method includes where the three-way valve is positioned at an outlet of the turbine bypass passage pipe and at an outlet of a turbine pipe. The method includes where the position of the three-way valve is adjusted via an actuator and a controller. The method includes where the centerline of the catalyst runs parallel with a longitudinal axis of cells included in the catalyst.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. An engine system, comprising:

a catalyst including a plurality of flow chambers;

a turbine pipe outlet arranged at about 45 degrees relative to a centerline of the catalyst;

a turbine bypass passage pipe outlet arranged at about 45 degrees relative to the centerline of the catalyst;

a three-way valve configured to distribute exhaust gas to the turbine bypass passage pipe outlet and the turbine pipe outlet; and an actuator to adjust a position of the three-way valve.

2. The engine system of claim 1, further comprising a controller including executable instructions stored in non-transitory memory that cause the controller to substantially fully close an inlet to a turbine pipe via the actuator during an engine cold start.

3. The engine system of claim 1, where the turbine pipe outlet and the turbine bypass passage pipe outlet are coupled to a housing for the catalyst.

4. The engine system of claim 1, where the three-way valve is positioned at an inlet of a turbine pipe and at an inlet of a turbine bypass passage pipe.

5. The engine system of claim 4, where the three-way valve is positioned between the inlet of the turbine pipe and the inlet of the turbine bypass passage pipe.

6. The engine system of claim 1, where the three-way valve is positioned at the turbine bypass passage pipe outlet and at the turbine pipe outlet.

7. The engine system of claim 6, where the three-way valve is positioned between the turbine pipe outlet and the turbine bypass passage pipe outlet.

8. A method for operating a turbocharger three-way valve, comprising:

adjusting a position of the turbocharger three-way valve to prevent exhaust gas flow through a turbine during an engine cold start;

flowing exhaust gases to a catalyst via a turbine bypass passage pipe that is arranged at about 45 degrees relative to a centerline of the catalyst during the engine cold start;

adjusting the position of the turbocharger three-way valve to allow exhaust gas flow through the turbine after the engine cold start and to prevent exhaust gas flow through the turbine bypass passage pipe after the engine cold start, wherein the exhaust gases flow from the turbine through a turbine pipe that is arranged about 45 degrees relative to a centerline of the catalyst.

9. The method of claim 8, where the turbocharger three-way valve is positioned at an outlet of the turbine bypass passage pipe and at an outlet of a turbine pipe.

10. The method of claim 8, where the position of the turbocharger three-way valve is adjusted via an actuator and a controller.

11. The method of claim 8, further comprising adjusting the position of the turbocharger three-way valve to permit exhaust gas flow through the turbine and the turbine bypass passage pipe.

12. The method of claim 11, where the turbocharger three-way valve is positioned at an inlet of the turbine bypass passage pipe and at an inlet of a turbine pipe.

13. The method of claim 11, where the centerline of the catalyst runs parallel with a longitudinal axis of cells included in the catalyst.

* * * * *